US008038263B2

(12) United States Patent
Oh et al.

(10) Patent No.: US 8,038,263 B2
(45) Date of Patent: Oct. 18, 2011

(54) PIEZOELECTRIC INKJET HEAD

(75) Inventors: Se-young Oh, Yongin-si (KR); Sang-kwon Wee, Swon-si (KR); Mi-Jeong Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 990 days.

(21) Appl. No.: 11/927,743

(22) Filed: Oct. 30, 2007

(65) Prior Publication Data

US 2009/0009565 A1 Jan. 8, 2009

(30) Foreign Application Priority Data

Jul. 3, 2007 (KR) ..... 10-2007-0066768

(51) Int. Cl.
*B41J 2/045* (2006.01)

(52) U.S. Cl. ..... 347/68

(58) Field of Classification Search ..... 347/68
See application file for complete search history.

(56) References Cited

U.S. PATENT DOCUMENTS 4,835,554 A * 5/1989 Hoisington et al. ..... 347/94

* cited by examiner

*Primary Examiner* — Jerry Rahll
(74) *Attorney, Agent, or Firm* — Stanzione & Kim, LLP

(57) ABSTRACT

A piezoelectric inkjet head includes a plurality of pressure chambers filled with ink that is to be ejected, a manifold to supply ink to the pressure chambers and extending in both sides of each of the pressure chambers parallel to a direction in which the pressure chambers are arranged, a restrictor to connect the manifold to each of the pressure chambers, and to be connected to both ends of each of the pressure chambers in a longitudinal direction, a plurality of piezoelectric actuators respectively corresponding to the pressure chambers, and at least one nozzle respectively connected to each of the pressure chambers, and to be symmetrically arranged with respect to the centerline in a longitudinal direction of each of the pressure chamber. The at least one nozzle includes a first nozzle and at least two second nozzles, the first nozzle is disposed to correspond to the centerline in the longitudinal direction of each of the pressure chambers, and the second nozzles are disposed in both sides of the first nozzle.

18 Claims, 6 Drawing Sheets

PIEZOELECTRIC INKJET HEAD

CROSS-REFERENCE TO RELATED APPLICATIONS

This application claims the benefit of Korean Patent Application No. 10-2007-0066768, filed on Jul. 3, 2007, in the Korean Intellectual Property Office, the disclosure of which is incorporated herein in its entirety by reference.

BACKGROUND OF THE INVENTION

1. Field of the Invention

The present general inventive concept relates to a piezoelectric inkjet head, and more particularly, to a piezoelectric inkjet head including restrictors and nozzles that are symmetrically arranged with respect to a pressure chamber.

2. Description of the Related Art

An inkjet head is a device for printing a predetermined color image by ejecting minute droplets of ink on desired areas of a printing medium. Inkjet heads can be generally classified into various types according to their method of ejecting ink droplets. One type is a thermal inkjet head that ejects ink droplets using the expansion force of ink bubbles created using a heat source, and the other type is a piezoelectric inkjet head that ejects inkjet droplets using a pressure created by the deformation of a piezoelectric element.

Piezoelectric inkjet heads have been used in an industrial inkjet printer as well as an inkjet printer for office automation (OA), and have also been variously used in printing fields in which high precision is required when manufacturing a color filter for a liquid crystal display device (LCD), an organic light emitting diode (OLED) or metal jetting.

FIG. 1 is a plan view of a conventional piezoelectric inkjet head. FIG. 2 is a cross-sectional view of the conventional piezoelectric inkjet head taken along a line A-A' of FIG. 1.

Referring to FIGS. 1 and 2, the conventional piezoelectric inkjet head includes a flow channel plate 20 in which an ink flow channel is formed, a nozzle plate 30, in which a plurality of nozzles 32 from which ink is ejected, is formed, and a plurality of piezoelectric actuators 40. Both of the flow channel plate 20 and the nozzle plate 30 are formed of silicon. A manifold 21, a plurality of restrictors 23 and a plurality of pressure chambers 22 are formed in the flow channel plate 20. The manifold 21 is a channel through which ink inflows from an ink storage (not shown). The pressure chambers 22 are places filled with ink that is to be ejected, and are arranged in one side or both sides of the manifold 21. The restrictors 23 are channels connecting the manifold 21 to the pressure chambers 22. Meanwhile, a plurality of dampers 24 and 31 connecting each of the nozzles 32 to each of the pressure chambers 22 is further formed between each of the nozzles 32 and each of the pressure chambers 22. In addition, the piezoelectric actuators 40 are disposed on the flow channel plate 20 to respectively correspond to the pressure chambers 22. The pressure chambers 22 have a stack structure of a lower electrode functioning as a common electrode, a piezoelectric film that changes according to a driving signal, and an upper electrode functioning as a driving electrode. The flow channel plate 20, disposed with the pressure chambers 22, functions as a vibration plate 26 that is transformed by driving the pressure chambers 22.

In the conventional piezoelectric inkjet head having such structure, when a driving signal is supplied to the pressure chambers 22, the vibration plate 26, which is disposed above each the pressure chambers 22, is transformed. In this case, the volumes of the pressure chambers 22 are reduced, and thus ink is ejected outside through the nozzles 32 due to the increase in the pressure inside the pressure chambers 22. Then, when the driving signal that is supplied to the pressure chambers 22 is removed, the volumes of the pressure chambers 22 increase, and thus ink is refilled into the pressure chambers 22 from the manifold 21 through the restrictors 23 due to the reduction in the pressure inside the pressure chambers 22.

However, in the conventional piezoelectric inkjet head, each of the restrictors 23 is connected to one end of each of the pressure chambers 22, and each of the nozzles 32 is connected to the other end of each of the pressure chambers 22. Thus, since the propagation path of a pressure wave P that is generated by driving the piezoelectric actuators 40 is increased as illustrated in FIG. 2, loss in the intensity of the pressure wave P, which is propagated to the nozzles 32, is incurred. A direction of the pressure wave P does not correspond to a longitudinal direction of each of the nozzles 32. Accordingly, the meniscus of the ink of the nozzles 32 is unstable, and the linearity of ink ejected from the nozzles 32 deteriorates. In addition, when a color filter is manufactured using a conventional piezoelectric inkjet head, ink droplets having a large volume are ejected to a local area of each pixel of the color filter, and thus ink may overflow outside a pixel.

SUMMARY OF THE INVENTION

The present general inventive concept provides a piezoelectric inkjet head including restrictors and nozzles that are symmetrically arranged with respect to the center of a pressure chamber so that a propagation path of a pressure wave generated by driving a piezoelectric actuator may be reduced and the meniscus of the ink of the nozzles may be stabilized.

Additional aspects and utilities of the present general inventive concept will be set forth in part in the description which follows and, in part, will be obvious from the description, or may be learned by practice of the general inventive concept.

These and other aspects and utilities of the present general inventive concept may be achieved by providing a piezoelectric inkjet head including a plurality of pressure chambers filled with ink that is to be ejected, a manifold to supply the ink to the pressure chamber and to extend in both sides of each of the pressure chambers parallel to a direction in which the pressure chambers are arranged, a restrictor to connect the manifold to each of the pressure chambers and connected to both sides of each of the pressure chambers in a longitudinal direction, a plurality of piezoelectric actuators respectively corresponding to the pressure chambers, and at least one nozzle respectively connected to each of the pressure chambers to be symmetrically arranged with respect to the centerline in a longitudinal direction of each of the pressure chambers.

The at least one nozzle may include a nozzle disposed to correspond to the centerline in the longitudinal direction of each of the pressure chambers.

The at least one nozzle may include a first nozzle, which is disposed to correspond to the centerline in the longitudinal direction of each of the pressure chambers, and at least two second nozzles, which are disposed in both sides of the first nozzle.

The piezoelectric inkjet head may further include a damper respectively connecting each of the pressure chambers and each of the nozzles.

The damper may have inclined sides.

The damper may include a first damper having inclined sides, and a second damper that is connected to the first damper and has a shape of a cylinder having a predetermined diameter. In this case, the first damper may be directly connected to each of the nozzles, and the second damper may be directly connected to each of the pressure chambers.

The piezoelectric inkjet head may further include an ink supplying inlet connected to the manifold and supplying ink to the inside of the manifold.

The pressure chambers, the manifold and the at least one nozzle may be formed in a flow channel plate, and the piezoelectric actuators are formed on the flow channel plate.

The flow channel plate may include a first substrate and a second substrate adhered to a lower surface of the first substrate, and the pressure chambers, the manifold and the restrictor are formed in the first substrate, and the at least one nozzle may be formed in the second substrate.

The flow channel plate may further include a third substrate stacked on the first substrate, and the manifold formed in the first substrate may extend to a level of the third substrate.

The piezoelectric inkjet head may further include a damper respectively connecting each of the pressure chambers to the at least one nozzle in the second substrate. The damper may have inclined sides.

The flow channel plate may include a first substrate, a second substrate adhered to a lower surface of the first substrate, and a third substrate adhered to a lower surface of the second substrate, the pressure chambers may be formed in the first substrate, the manifold and the restrictor may be formed in the second substrate, and the at least one nozzle may be formed in the third substrate.

Dampers connecting each of the pressure chambers to the at least one nozzle may be formed in the second substrate and the third substrate. The damper may include a first damper formed in the third substrate and having inclined sides, and second damper formed in the second substrate so as to be connected to the first damper and having the shape of a cylinder having a predetermined diameter.

These and other aspects and utilities of the present general inventive concept may be achieved by providing an image forming apparatus including a piezoelectric inkjet head having a plurality of pressure chambers filled with ink that is to be ejected, arranged in a first direction, and extended in a second direction, a manifold extended in both sides of each of the pressure chambers in the first direction to supply ink to the pressure chambers, a restrictor connected to both ends of each of the pressure chambers and formed in a longitudinal direction to connect the manifold to the corresponding pressure chambers, a plurality of piezoelectric actuators respectively corresponding to the pressure chambers, and at least one nozzle respectively connected to each of the pressure chambers and disposed on a centerline of the pressure chamber in the second direction of each of the pressure chambers, and a unit to control a relative position between the piezoelectric inkjet head and a printing medium.

These and other aspects and utilities of the present general inventive concept may be achieved by providing a piezoelectric inkjet head including a pressure chamber to be filled with ink, and a nozzle disposed on a center line of the pressure chamber to eject the ink.

The piezoelectric inkjet head may further include a plurality of manifolds disposed opposite sides of the pressure chamber to supply ink to the pressure chamber from both sides thereof.

The nozzle may be spaced apart from the plurality of manifolds by a same distance.

The piezoelectric inkjet head may further include a plurality of restrictors disposed between the pressure chamber and each of the manifold.

The nozzle may be spaced apart from the plurality of restrictors by a same distance.

The piezoelectric inkjet head may further include a first substrate formed with the pressure chamber, the restrictors, and the manifolds, and a second substrate formed with the nozzle and attached to the first substrate to define the pressure chamber, the restrictors, and the manifolds.

The piezoelectric inkjet head may further include a piezoelectric actuator disposed to correspond to the pressure chamber and having a center portion of vibration to transmit a pressure to an inside of the pressure chamber, and the center portion of vibration of the piezoelectric actuator is disposed on the center line.

These and other aspects and utilities of the present general inventive concept may be achieved by providing an image forming apparatus including a piezoelectric inkjet head having a pressure chamber to be filled with ink, and a nozzle disposed on a center line of the pressure chamber to eject the ink, and a unit to control a relative position between the piezoelectric inkjet head and a printing medium to form at least one pixel on the printing medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
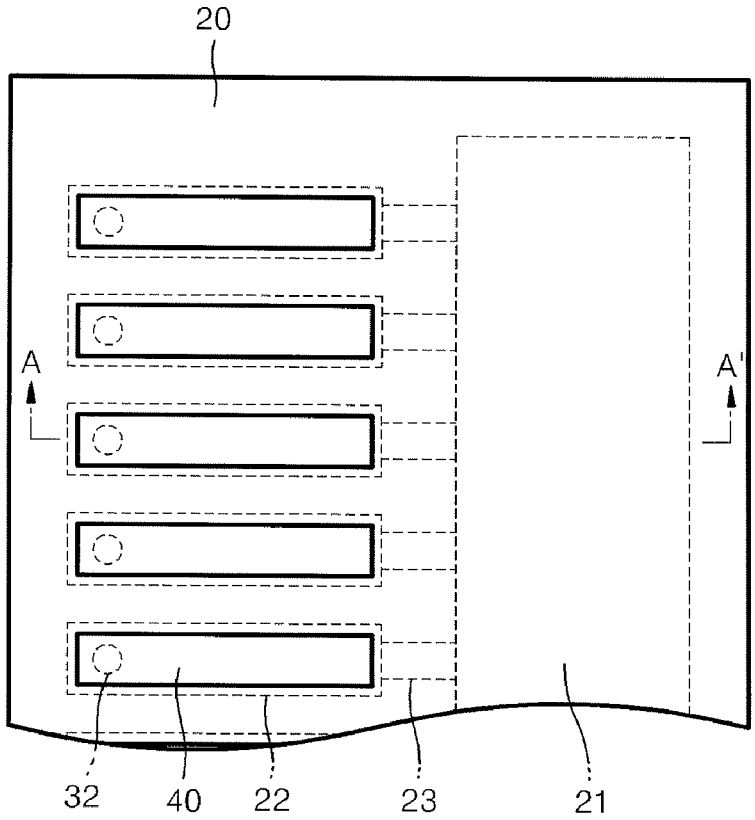
FIG. 1 (PRIOR ART)
FIG. 1 is a plan view of a conventional piezoelectric inkjet head.
Figure 2:
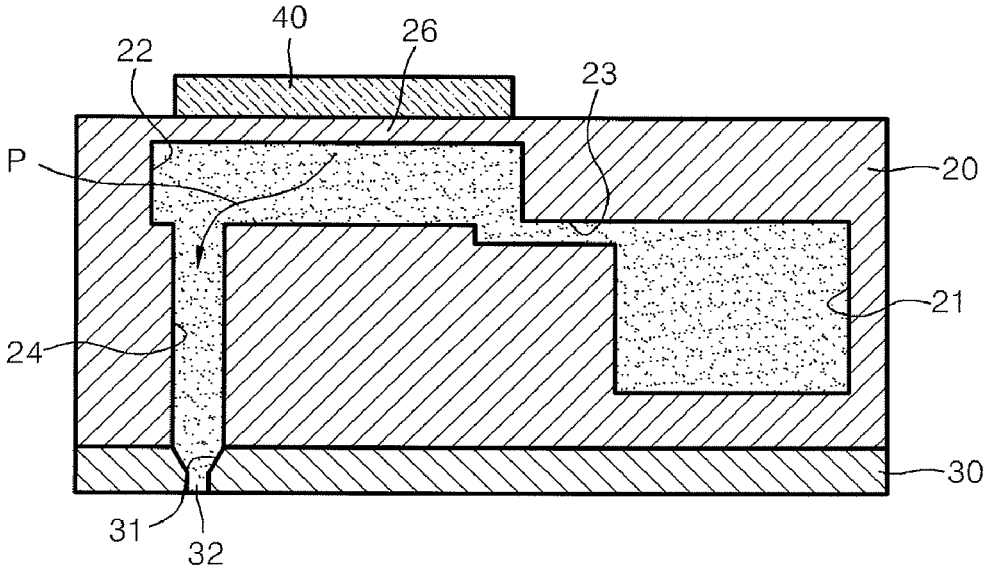
FIG. 2 (PRIOR ART)
FIG. 2 is a cross-sectional view of the conventional piezoelectric inkjet head taken along a line A-A' of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. In the drawings, the thickness of layers and region are exaggerated for clarity.

Figure 3:
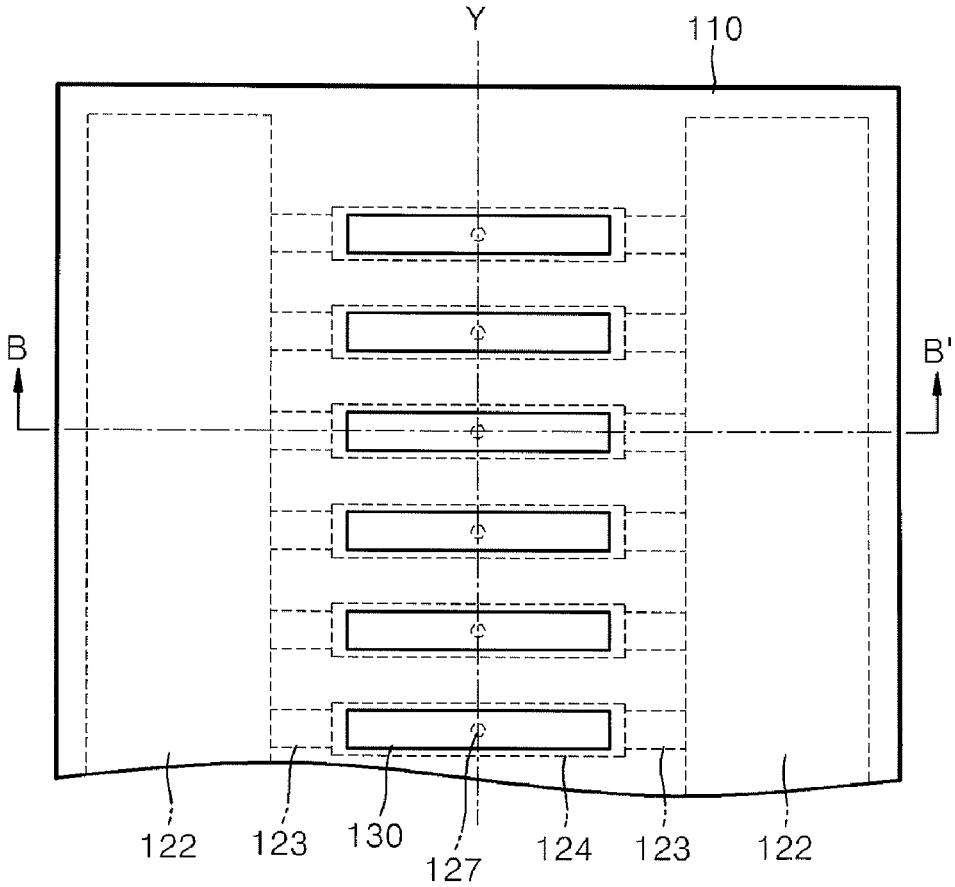
FIG. 3 is a plan view illustrating a piezoelectric inkjet head according to an embodiment of the present general inventive concept.
Figure 4A:
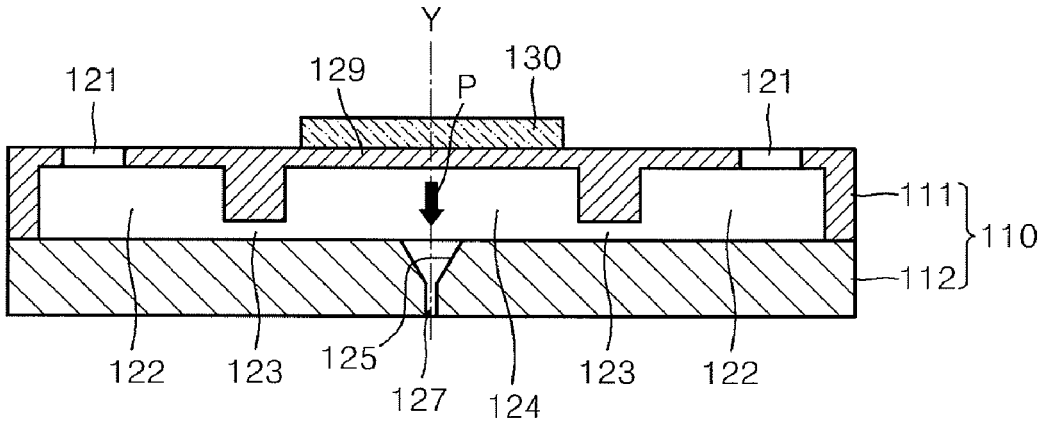
FIGS. 4A through 4C are cross-sectional views illustrating examples of the piezoelectric inkjet head taken along a line B-B' of FIG. 3, according to various embodiments of the present general inventive concept.
Figure 4B:
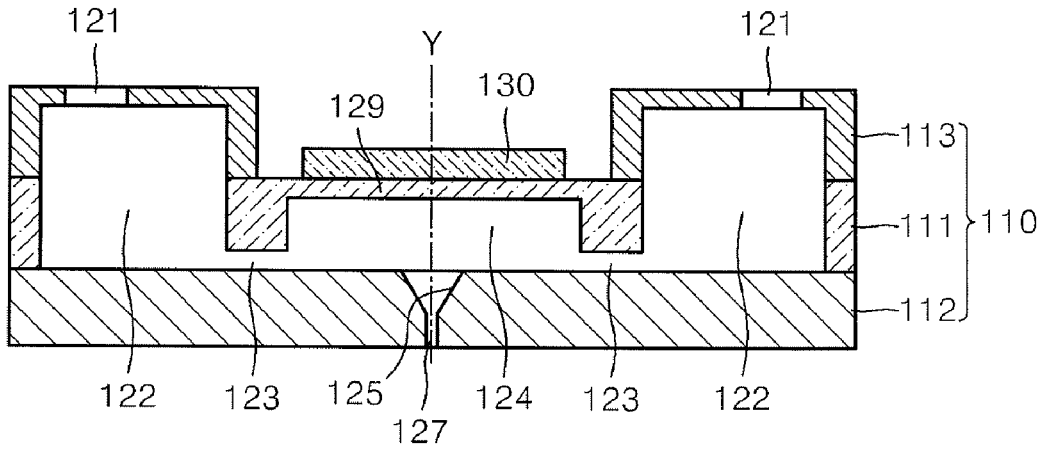
Figure 4C:
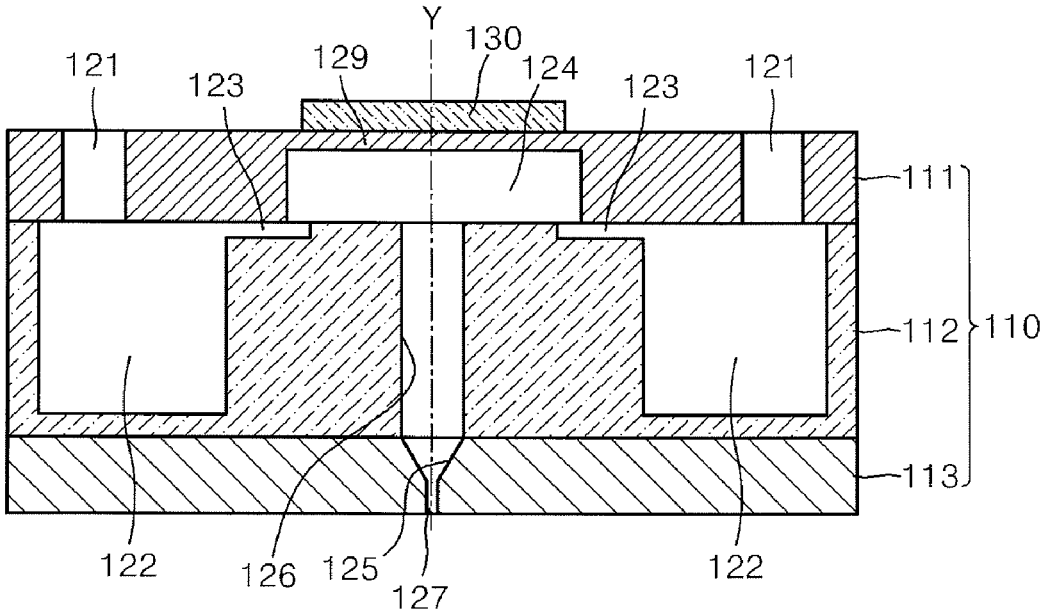

FIG. 3 is a plan view illustrating a piezoelectric inkjet head according to an embodiment of the present general inventive concept. FIGS. 4A through 4C are cross-sectional views illustrating examples of the piezoelectric inkjet head taken along a line B-B' of FIG. 3, according to embodiments of the present general inventive concept.

Referring to FIGS. 3 and 4A, the piezoelectric inkjet head includes an ink flow channel plate 110 in which an ink flow channel is formed, and on which a plurality of piezoelectric actuators 130 are formed.

The ink flow channel plate 110 may include a first substrate 111 and a second substrate 112 disposed on a lower surface of the first substrate 111. The second substrate 112 may be attached or bonded to the first substrate 111. Both of the first substrate 111 and the second substrate 112 may be formed of silicon. The first substrate 111 is formed with a plurality of manifolds 122 as common ink flow channels, and a plurality of pressure chambers 124 and a plurality of restrictors 123 as individual ink flow channels. The manifolds 122, the pressure chambers 124, and the restrictors 123 may be defined by the first substrate 111 and the second substrate 112. A plurality of nozzles 127, which are individual ink flow channels, are formed in the second substrate 112. The pressure chambers 124 are formed in the first substrate 111, are a place filled with ink that is to be ejected, and are spaced apart by predetermined intervals in a first direction to extend in a second direction. Each of the pressure chambers 124 may have a shape of a rectangular parallelepiped that extends in the second direction substantially perpendicular to the first direction in which the pressure chambers 124 are arranged. The manifolds 122 supply ink to the pressure chambers 124, are connected to both sides of the pressure chambers 124 and are disposed in a direction parallel to the first direction in which the pressure chambers 124 are arranged. The manifolds 122 are filled with ink supplied from an ink storage (not illustrated) through an ink supplying inlet 121. The restrictors 123 are channels that respectively connect the manifolds 122 to the corresponding pressure chambers 124, are connected to both ends of the pressure chambers 124, and are disposed in a longitudinal direction substantially parallel to the first direction.

The nozzles 127 are formed in the second substrate 112, are respectively connected to the corresponding pressure chambers 124, and eject ink droplets from the corresponding pressure chambers 124. The nozzles 127 may be arranged to be disposed on a centerline Y, and at least one of the nozzles is symmetrically disposed to correspond to a center portion of the pressure chamber in a longitudinal direction of each of the pressure chambers 124 to be connected to each of the pressure chambers 124. The longitudinal direction of each of the pressure chambers 124 may be substantially parallel to the second direction, and the nozzles 127 are formed in a third direction substantially perpendicular to the first direction and the second direction, as an ink ejection direction, for example. In particular, as illustrated in FIG. 4A, each of the nozzles 127 may be correspondingly arranged on the centerline Y and in the longitudinal direction of each of the pressure chambers 124.

In addition, a damper 125 may be formed in the second substrate 112 top connect the pressure chamber 24 to the nozzle 127. The damper 125 may have inclined sides to define a passage of the ink. Also, a shape of the damper 125 may be formed by wet-etching the second substrate 112.

Center lines of the damper 125 and the nozzle 127 may be disposed in the third direction in which the ink is ejected from the pressure chamber 124 to an outside of the inkjet head.

The piezoelectric actuators 130 are formed on the ink flow channel plate 110 (i.e. on the first substrate 111) so as to respectively correspond to the pressure chambers 124, and the piezoelectric actuators 130 change a pressure inside the pressure chambers 124 by vibrating the first substrate 111 in which the pressure chambers 124 are formed. The first substrate 111 disposed above the pressure chambers 124 functions as a vibration plate 129 that is transformed by driving the piezoelectric actuators 130. The piezoelectric actuators 130 each include a lower electrode (not illustrated) formed so as to cover an upper surface of the first substrate 111, a piezoelectric film (not illustrated) formed on the lower electrode, and an upper electrode (not illustrated) formed on the piezoelectric film. The lower electrode functions as a common electrode. The upper electrode functions as a driving electrode that applies a voltage to the piezoelectric film. Then, the piezoelectric film is transformed by the applied voltage, so as to vibrate the vibration plate 129 disposed above the pressure chambers 124. The piezoelectric film may be formed of a predetermined piezoelectric material (e.g., lead zirconate titanate (PZT) ceramic).

As described above, the restrictors 123 are connected to both ends of the pressure chambers 124, and each of the nozzles 127 is correspondingly arranged on the centerline Y in the longitudinal direction of each of the pressure chambers 124. Thus, the restrictors 123 and the nozzles 127 are symmetrically arranged with respect to the centerline Y in the longitudinal direction of each the pressure chambers 124. A pressure wave P, generated by driving the piezoelectric actuators 130, can be directly propagated to the nozzles 127, and the propagation path of the pressure wave P is reduced to thereby increase energy efficiency. The direction of the pressure wave P corresponds to the longitudinal direction of each of the nozzles 127. Thus, the meniscus of the ink of the nozzles 127 is stabilized, and the linearity of ink ejected from the nozzles 127 is improved. In addition, since the restrictors 123 are connected to both ends of the pressure chambers 124, ink can be refilled in the pressure chambers 124 without delay after ejecting the ink.

The manifolds 122 have the same height as the pressure chamber 124 in the third direction, and are disposed opposite to each other with respect to the pressure chamber 124 or the center line Y to be connected to opposite sides of the pressure chamber 124. That is, the pressure chamber 124 is disposed between the manifolds 122 to receive ink from the manifolds 122.

The piezoelectric actuator 130 is disposed in the second direction and has an area to correspond to an area of the pressure chamber 124 in the second direction such that vibration is transmitted to the pressure chamber 124 to generate a pressure to an inside of the pressure chamber to eject the ink through the damper 125 and the nozzle 127. The vibration area of the piezoelectric actuator 130 may have a center portion disposed on a center of the pressure chamber. It is possible that the center portion of the piezoelectric actuator 130 is disposed on the center line Y. It is possible that the center lines of the damper 125 and the nozzle 127 are disposed on the center portion of the piezoelectric actuator 130.

Referring to FIG. 4B, an ink flow channel plate 110 may further include a third substrate 113 stacked on a first substrate 111. Manifolds 122 formed in the first substrate 111 may extend to a level of the third substrate 113. In this case, an ink supplying inlet 121 connected to each of the manifolds 122 may be formed in the third substrate 113.

As described above, when the manifolds 122 are formed to extend from the first substrate 111 to the third substrate 113, the volume of each of the manifolds 122 increases, and thus enough amount of ink can be stored in the manifolds 122.

Spaces defined by the manifold 122, the restrictors 123, and the pressure chamber 124 may be disposed on a common plane. The spaces of the manifold 122 and the pressure chamber 124 may be same and may be different from the space of the restrictor in the third direction. The manifold 122 may have a height higher than the pressure chamber 124 in a direction parallel to the third direction.

Referring to FIG. 4C, the ink flow channel plate 110 may include three substrates, that is, the first substrate 111, the second substrate 112 adhered to a lower surface of the first substrate 111, and a third substrate 113 adhered to a lower surface of the second substrate 112. All of the first substrate 111, the second substrate 112 and the third substrate 113 may be formed of silicon.

The pressure chambers 124 are formed in the first substrate 111. The manifolds 122 and the restrictors 123 are formed in the second substrate 112. At least one of the nozzles 127 is formed in the third substrate 113. In this case, the ink supplying inlet 121, connected to each of the manifolds 122, may be formed in the first substrate 111.

Dampers 125 and 126, which respectively connect each of the pressure chambers 124 to at least one of each of the nozzles 127, may be respectively formed in the second substrate 112 and the third substrate 113. The dampers 125 and 126 may include a first damper 125 and a second damper 126. The first damper 125, is formed in the third substrate 113, and has inclined sides. The second damper 126 is formed in the second substrate 112 so as to be connected to the first damper 125, wherein the shape of the second damper 126 is a cylinder having a predetermined diameter. In addition, the first damper 125 may be formed by wet-etching the third substrate 113, and the second damper 126 may be formed by dry-etching the second substrate 112.

The ink is supplied to the manifold 122 through the ink inlet 121 in a direction parallel to an ink ejecting direction or the third direction in which the ink is ejected from the pressure chamber 124 through the nozzle 127.

Figure 5:
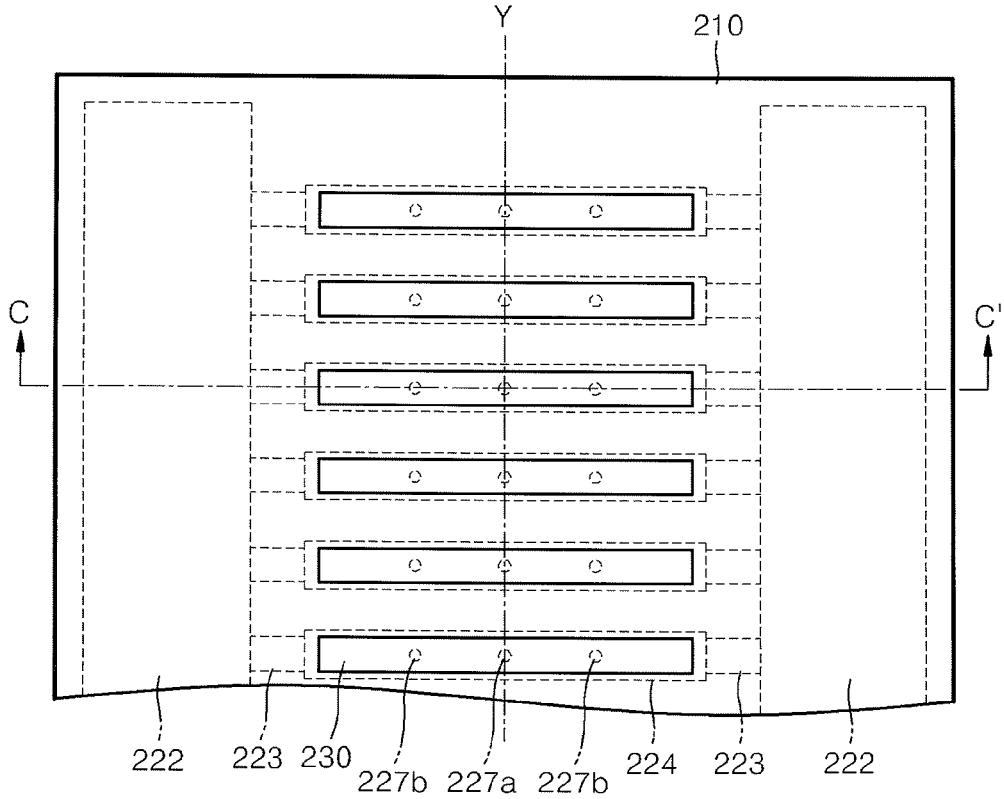
FIG. 5 is a plan view illustrating a piezoelectric inkjet head according to another embodiment of the present general inventive concept.
Figure 6A:
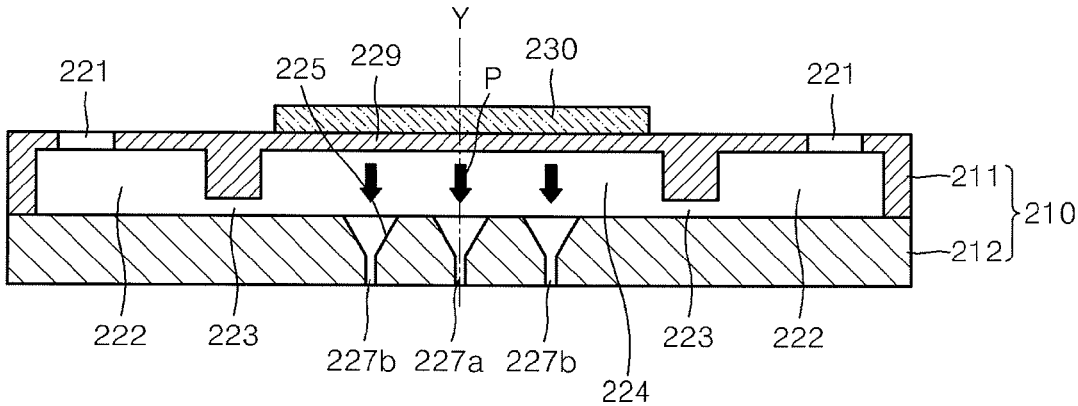
FIGS. 6A through 6C are cross-sectional views illustrating examples of the piezoelectric inkjet head taken along a line C-C' of FIG. 5, according to various embodiments of the present general inventive concept.
Figure 6B:
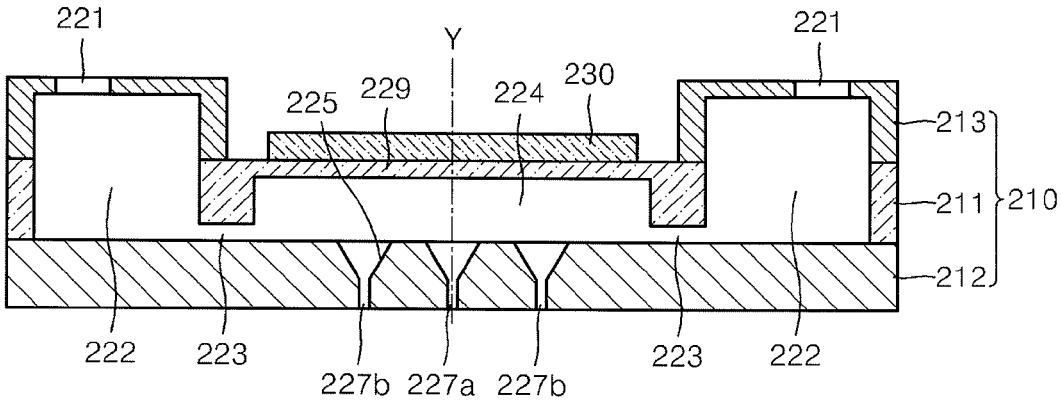
Figure 6C:
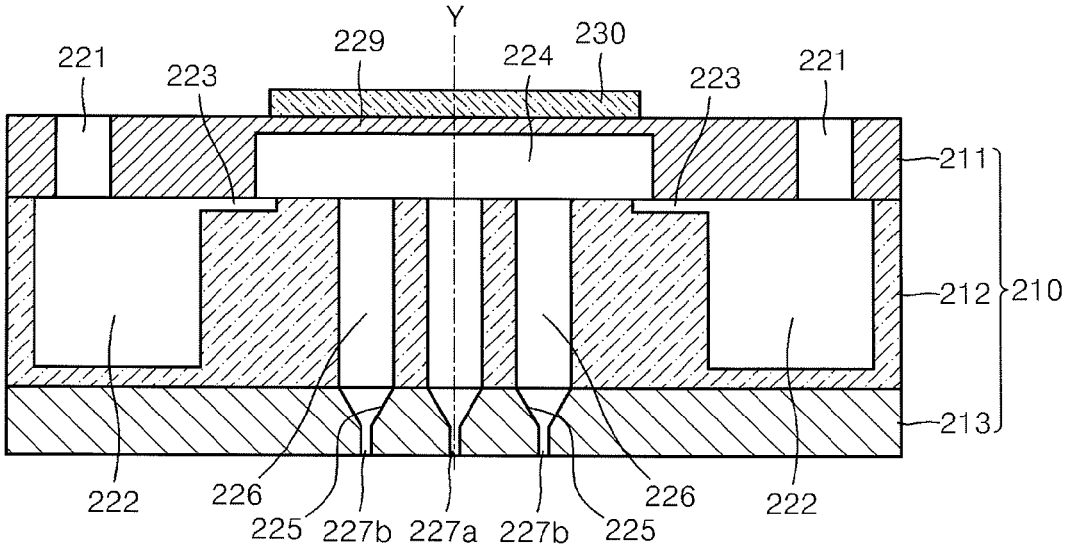

FIG. 5 is a plan view of a piezoelectric inkjet head according to another embodiment of the present general inventive concept. FIGS. 6A through 6C are cross-sectional views illustrating examples of the piezoelectric inkjet head taken along a line C-C' of FIG. 5, according to various embodiments of the present general inventive concept. The piezoelectric inkjet head of FIG. 5 is the same as the piezoelectric inkjet head of FIG. 3 except that a plurality of nozzles are connected to one pressure chamber, and thus the piezoelectric inkjet head of FIG. 5 will be described in terms of its differences from the above-described embodiments.

Referring to FIGS. 5 and 6A, the piezoelectric inkjet head includes a flow channel plate 210 formed with an ink flow channel, and a plurality of piezoelectric actuators 230 formed on the flow channel plate 210.

The flow channel plate 210 may include a first substrate 211 and a second substrate 212 disposed on a lower surface of the first substrate 211. The second substrate 211 may be attached or bonded to the first substrate 211. Both of the first substrate 211 and the second substrate 212 may be formed of silicon. Manifolds 222, which are common ink flow channels, and a plurality of pressure chambers 224 and a plurality of restrictors 223, which are individual ink flow channels, are formed in the first substrate 211. A plurality of nozzles 227*a* and 227*b* are formed in the second substrate 212. The pressure chambers 224 formed in the first substrate 211 are spaced apart in a first direction by predetermined intervals to extend in a second direction substantially perpendicular to the first direction. The manifolds 222 extend in both sides of the pressure chambers 224 in the first direction parallel to a direction in which the pressure chambers 224 are arranged. The manifolds 222 are filled with ink supplied from an ink storage (not illustrated) through an ink supplying inlet 221. The restrictors 223 are channels that respectively connect the manifolds 222 to the pressure chambers 224, are respectively connected to both ends of the pressure chambers 224 in the second direction, and are extended in a longitudinal direction. The longitudinal direction may be the first direction. The restrictors 223 may protrude toward the second substrate 212 to define the manifolds 222 and the pressure chamber 224.

The nozzles 227*a* and 227*b*, which are symmetrically arranged with respect to the centerline Y in a longitudinal direction of each of the pressure chambers 224, are connected to each of the pressure chambers 224. In particular, as illustrated in FIG. 5A, a first nozzle 227*a* is correspondingly arranged on the centerline Y in the longitudinal direction of each of the pressure chambers 224, and two second nozzles 227*b* are arranged at both sides of the first nozzle 227*a*. In the present embodiment, the number of second nozzles 227*b* arranged at both sides of the first nozzle 227*a* may be more than a multiple of two.

The nozzles 227*a* and 227*b* are disposed on an area corresponding to an area of the corresponding piezoelectric actuator 230 and/or an area of the pressure chamber 224 so as to transmit vibration and generate a pressure to eject the ink.

Dampers 225, which respectively connect each of the pressure chambers 224 to the nozzles 227*a* and 227*b*, may be formed in the second substrate 212. The dampers 225 may have inclined sides, and the dampers 225 having such shape may be formed by wet-etching the second substrate 212.

The piezoelectric actuators 230 are formed on the flow channel plate 210 (i.e., on the first substrate 211) so as to respectively correspond to the pressure chambers 224. The first substrate 211 disposed above the pressure chambers 224 functions as a vibration plate 229 that is transformed by driving the piezoelectric actuators 230.

As described above, the restrictors 223 are connected to both ends of the pressure chambers 224, and each of the nozzles 227*a* and 227*b* is correspondingly arranged with respect to the centerline Y in the longitudinal direction of each of the pressure chambers 224. Accordingly, the piezoelectric inkjet head of FIG. 5 can have the same advantages as those of the piezoelectric inkjet head of FIG. 3, as described above.

Figure 7:
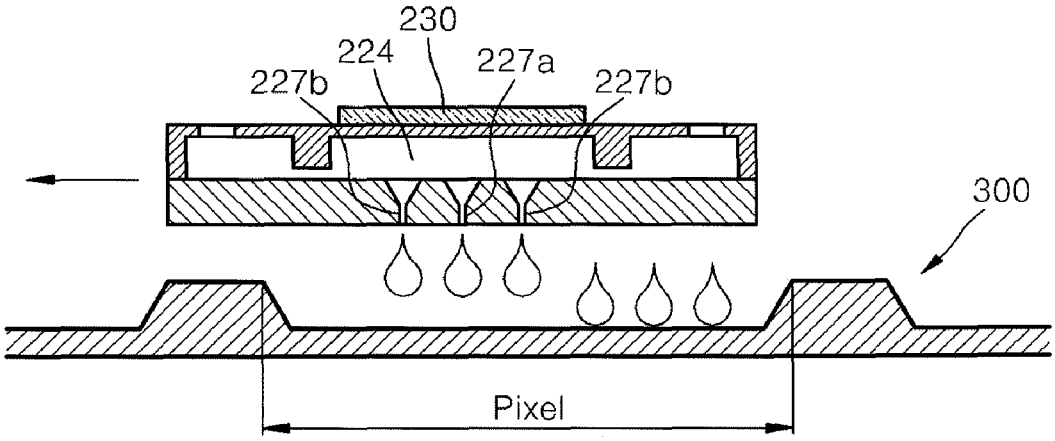
FIG. 7 is a cross-sectional view for illustrating a method of printing a color filter using the inkjet head of FIG. 6A, according to an embodiment of the present general inventive concept.

In particular, the intensity of a pressure wave P propagated to each of the nozzles 227*a* and 227*b* is reduced by connecting the nozzles 227*a* and 227*b* to one of the pressure chambers 224, as illustrated in FIG. 6A. Accordingly, as illustrated in FIG. 7, when a printing medium, such as a color filter 300, is printed using the piezoelectric inkjet head of FIG. 6A in an image forming apparatus, a plurality of ink droplets having reduced volumes can be ejected from each of the pressure chambers 224 through the nozzles 227*a* and 227*b* by driving the piezoelectric actuators 230. Accordingly, the ink droplets having reduced volumes can be regularly distributed on a wide area of each pixel of the color filter 300, and ink can be prevented from overflowing outside a pixel.

The image forming apparatus may have a unit to control a relative position and/or a relative movement between the piezoelectric inkjet head and the color filter 300 to print or form at least one pixel using the ink ejected from the piezoelectric inkjet head. The piezoelectric inkjet head may perform a stable and/or uniform ink ejection toward the color filter 300 according to the structures of the piezoelectric inkjet head of FIGS. 3-6C.

Referring to FIG. 6B, the flow channel plate 210 may further include a third substrate 213 stacked on the first substrate 211. Manifolds 222 formed in the first substrate 211 may extend to a level of the third substrate 213, and thus the volumes of the manifolds 222 increases. In the present embodiment, an ink supplying inlet 221 may be formed in each of the manifolds 222 to connect to the manifolds 222.

Referring to FIG. 6C, the flow channel plate 210 may include three substrates, that is, the first substrate 211, the second substrate 212 adhered to a lower surface of the first substrate 211, and the third substrate 213 adhered to a lower surface of the second substrate 212.

The pressure chambers 224 are formed in the first substrate 211. Manifolds 222 and restrictors 223 are formed in the second substrate 212. In the present embodiment, the nozzles 227*a* and 227*b* are formed in the third substrate 213. In this case, the ink supplying inlet 221 connected to each of the manifolds 222 may be formed in the first substrate 211.

Dampers 225 and 226, which respectively connect each of the pressure chambers 224 to the nozzles 227*a* and 227*b*, may be respectively formed in the second substrate 212 and the third substrate 213.

Each of the dampers 225 and 226 may include a first damper 225 and a second damper 226. The first damper 225 is formed in the third substrate 213 and has inclined sides. The second damper 226 is formed in the second substrate 212 in the second substrate 212 so as to be connected to the first damper 225, wherein the shape of the second damper 226 is a cylinder having a predetermined diameter. In addition, the first damper 225 may be formed by wet-etching the third substrate 213, and the second damper 226 may be formed by dry-etching the second substrate 212.

As described above, according to the present general inventive concept, by symmetrically arranging restrictors and nozzles with respect to the centerline of a pressure chamber, a pressure wave generated by driving a piezoelectric actuator can be directly propagated to the nozzles, and the propagation path of the pressure wave can be reduced to thereby increase energy efficiency.

Since the direction of the pressure wave corresponds to a longitudinal direction of each of the nozzles, or is symmetrical to the longitudinal direction of each of the nozzles, the meniscus of the ink of the nozzles is stabilized, and the linearity of ink ejected from the nozzles is improved.

Since the restrictors are connected to both ends of the pressure chambers, ink can be refilled in the pressure chambers without delay after ejecting the ink.

In addition, when a color filter is printed using an inkjet head having a plurality nozzles in the pressure chambers, a plurality of ink droplets can be regularly distributed in each pixel of the color filter, and ink can be prevented from regularly overflowing outside a pixel.

While the present general inventive concept has been particularly shown and described with reference to exemplary embodiments thereof, it will be understood by those of ordinary skill in the art that various changes in form. For example, a flow channel plate is illustrated to have two or three substrates. However, the present general inventive concept is not limited thereto. That is, a flow channel plate can have more than three substrates. The structure of an ink flow formed in each substrate of the flow channel plate can be changed. In addition, although one nozzle or three nozzles are illustrated to be connected to one pressure chamber, the present general inventive concept is not limited thereto. That is, more than five nozzles can be connected to one pressure chamber. Accordingly, details may be made therein without departing from the spirit and scope of the present invention as defined by the following claims.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A piezoelectric inkjet head comprising:

a pressure chamber to be filled with ink;

a nozzle disposed on a center of the pressure chamber to eject the ink;

a plurality of manifolds disposed on opposite sides of the pressure chamber to supply ink to the pressure chamber from both opposite sides thereof;

a plurality of restrictors disposed between the pressure chamber and each of the manifolds;

a first substrate formed with the pressure chamber, the restrictors, and the manifolds; and a second substrate formed with the nozzle and attached to the first substrate to define the pressure chamber, the restrictors, and the manifolds.

2. The piezoelectric inkjet head of claim 1, wherein the nozzle is spaced apart from the plurality of manifolds by a same distance.

3. The piezoelectric inkjet head of claim 1, wherein the nozzle is spaced apart from the plurality of restrictors by a same distance.

4. The piezoelectric inkjet head of claim 1, further comprising:

a piezoelectric actuator disposed to correspond to the pressure chamber and having a center portion of vibration to transmit a pressure to an inside of the pressure chamber, wherein the center portion of vibration of the piezoelectric actuator is disposed on the center line.

5. A piezoelectric inkjet head, comprising:

a plurality of pressure chambers filled with ink that is to be elected, arranged in a first direction, and extended in a second direction;

a manifold extended in both sides of each of the pressure chambers in the first direction to supply ink to the pressure chambers;

a restrictor connected to both ends of each of the pressure chambers and formed in a longitudinal direction to connect the manifold to the corresponding pressure chambers;

a plurality of piezoelectric actuators respectively corresponding to the pressure chambers; and at least one nozzle respectively connected to each of the pressure chambers and disposed on a center of the pressure chamber in the second direction of each of the pressure chambers, wherein the at least one nozzle comprises a first nozzle, which is disposed to correspond to the centerline in the longitudinal direction of each of the pressure chambers, and at least two second nozzles, which are disposed in both sides of the first nozzle.

6. The piezoelectric inkjet head of claim 5, further comprising:

a damper to respectively connect each of the pressure chambers and each of the nozzles.

7. The piezoelectric inkjet head of claim 6, wherein the damper has inclined sides.

8. The piezoelectric inkjet head of claim 5, further comprising:

an ink supplying inlet connected to the manifold to supply ink to an inside of the manifold.

9. The piezoelectric inkjet head of claim 5, wherein:

the pressure chambers, the manifold, and the at least one nozzle are formed in a flow channel plate; and the piezoelectric actuators are formed on the flow channel plate.

10. The piezoelectric inkjet head of claim 9, wherein:

the flow channel plate comprises a first substrate and a second substrate adhered to a lower surface of the first substrate; the pressure chambers, the manifold, and the restrictor are formed in the first substrate; and the at least one nozzle are formed in the second substrate.

11. The piezoelectric inkjet head of claim 10, wherein:

the flow channel plate further comprises a third substrate stacked on the first substrate; and the manifold formed in the first substrate extends to a level of the third substrate.

12. The piezoelectric inkjet head of claim 10, further comprising:

a damper respectively connecting each of the pressure chambers to the at least one nozzle in the second substrate.

13. The piezoelectric inkjet head of claim 12, wherein the damper has inclined sides.

14. The piezoelectric inkjet head of claim 9, wherein:

the flow channel plate comprises a first substrate, a second substrate attached to a lower surface of the first substrate, and a third substrate attached to a lower surface of the second substrate;

the pressure chambers are formed in the first substrate;

the manifold and the restrictor are formed in the second substrate; and the at least one nozzle is formed in the third substrate.

15. The piezoelectric inkjet head of claim 14, wherein dampers connecting each of the pressure chambers to the at least one nozzle are formed in the second substrate and the third substrate.

16. The piezoelectric inkjet head of claim 15, wherein the damper comprises a first damper formed in the third substrate and having inclined sides, and a second damper formed in the second substrate so as to be connected to the first damper and having a shape of a cylinder having a predetermined diameter.

17. A piezoelectric inkjet head, comprising:

a plurality of pressure chambers filled with ink that is to be ejected, arranged in a first direction, and extended in a second direction;

a manifold extended in both sides of each of the pressure chambers in the first direction to supply ink to the pressure chambers;

a restrictor connected to both ends of each of the pressure chambers and formed in a longitudinal direction to connect the manifold to the corresponding pressure chambers;

a plurality of piezoelectric actuators respectively corresponding to the pressure chambers: and at least one nozzle respectively connected to each of the pressure chambers and disposed on a center of the pressure chamber in the second direction of each of the pressure chambers; and a damper to respectively connect each of the pressure chambers and each of the nozzles, wherein the damper comprises:

a first damper having inclined sides; and a second damper that is connected to the first damper and has a shape of a cylinder having a predetermined diameter.

18. The piezoelectric inkjet head of claim 17, wherein:

the first damper directly connected to each of the nozzles; and the second damper directly connected to each of the pressure chambers.

* * * * *